US011524193B2

(12) United States Patent
Shively et al.

(10) Patent No.: US 11,524,193 B2
(45) **Date of Patent: *Dec. 13, 2022**

(54) FIRE APPARATUS PIERCING TIP RANGING AND ALIGNMENT SYSTEM

(71) Applicant: Oshkosh Corporation, Oshkosh, WI (US)

(72) Inventors: Jason Shively, Oshkosh, WI (US); David Kay, Appleton, WI (US); Noah Kuntz, Oshkosh, WI (US); Tim Nelson, Oshkosh, WI (US)

(73) Assignee: Oshkosh Corporation, Oshkosh, WI (US)

( * ) Notice: Subject to any disclaimer, the term of this patent is extended or adjusted under 35 U.S.C. 154(b) by 19 days.

This patent is subject to a terminal disclaimer.

(21) Appl. No.: 16/409,315

(22) Filed: May 10, 2019

(65) Prior Publication Data

US 2019/0262643 A1 Aug. 29, 2019

Related U.S. Application Data

(63) Continuation of application No. 15/705,952, filed on Sep. 15, 2017, now Pat. No. 10,286,239.
(Continued)

(51) Int. Cl.
*A62C 31/22* (2006.01)
*B05B 12/12* (2006.01)
(Continued)

(52) U.S. Cl.
CPC ..... *A62C 31/22* (2013.01); *A62C 3/08* (2013.01); *A62C 31/24* (2013.01); *B05B 12/124* (2013.01)

(58) Field of Classification Search
CPC ..... A62C 31/22; A62C 3/08; A62C 31/24; B05B 12/124
See application file for complete search history.

(56) References Cited

U.S. PATENT DOCUMENTS 1,001,863 A 8/1911 Kirkwood
1,376,467 A 5/1921 Simmon
(Continued)

FOREIGN PATENT DOCUMENTS

CA 2478228 A1 2/2006
CN 203050481 7/2013
(Continued)

OTHER PUBLICATIONS

International Search Report and Written Opinion regarding Application No. PCT/US2018/017216, dated Apr. 24, 2018, 11 pps.

*Primary Examiner* — Steven M Cernoch
(74) *Attorney, Agent, or Firm* — Foley & Lardner LLP

(57) ABSTRACT

A fire-fighting vehicle includes a boom assembly movably coupled to a chassis, a penetrating nozzle coupled to the boom assembly, an actuator that moves the penetrating nozzle relative to the chassis, and a controller operatively coupled to a sensor. The penetrating nozzle includes a piercing tip and an outlet configured to be selectively fluidly coupled to a supply of fire suppressant. The piercing tip is repositionable relative to a surface of an object having an interior cavity. The outlet supplies fire suppressant into the interior cavity when the piercing tip is within the interior cavity. The sensor provides data relating to at least one of a position and an orientation of the piercing tip relative to the surface. The controller determines an angular orientation of the piercing tip relative to the surface based on the data.

5 Claims, 8 Drawing Sheets

Related U.S. Application Data

(60) Provisional application No. 62/456,440, filed on Feb. 8, 2017.

(51) Int. Cl.
*A62C 31/24* (2006.01)
*A62C 3/08* (2006.01)

(56) References Cited

U.S. PATENT DOCUMENTS 1,463,569 A 7/1923 Bathrick
1,835,132 A 12/1931 Anania
2,614,743 A 10/1952 Arps
2,632,577 A 3/1953 Sacco
2,916,997 A 12/1959 Terrie
2,993,650 A 7/1961 Badberg
2,997,242 A 8/1961 Grosholz
3,010,533 A 11/1961 Ross
3,083,790 A 4/1963 McAfee et al.
3,188,966 A 6/1965 Tetlow
3,346,052 A 10/1967 Moore et al.
3,500,961 A 3/1970 Eberhardt et al.
3,550,146 A 12/1970 Eberle
3,590,948 A 7/1971 Milner, Jr.
3,675,721 A 7/1972 Davidson et al.
3,715,001 A 2/1973 Wilson
3,726,308 A 4/1973 Eberhardt
3,770,062 A 11/1973 Riggs
3,789,869 A 2/1974 Morris
4,037,664 A 7/1977 Gibson
4,059,170 A 11/1977 Young
4,084,522 A 4/1978 Younger
4,094,381 A 6/1978 Wilkerson
4,103,757 A 8/1978 McVaugh
4,118,151 A 10/1978 Murakami et al.
4,157,733 A 6/1979 Ewers et al.
4,160,492 A 7/1979 Johnston
4,185,924 A 1/1980 Graham
4,212,908 A 7/1980 Hendy et al.
4,317,504 A 3/1982 Artaud et al.
4,337,830 A 7/1982 Eberhardt
4,373,600 A 2/1983 Buschbom et al.
4,410,045 A 10/1983 Whitman
4,456,093 A 6/1984 Finley et al.
4,556,200 A 12/1985 Shoemaker
4,563,124 A 1/1986 Eskew
4,570,973 A 2/1986 Ewers et al.
4,586,743 A 5/1986 Edwards et al.
4,587,862 A 5/1986 Hoffman
4,811,804 A 3/1989 Ewers et al.
4,852,690 A 8/1989 Salmi
4,945,780 A 8/1990 Bosma
4,998,982 A 3/1991 Arnold et al.
5,004,156 A 4/1991 Montanier
5,021,917 A 6/1991 Pike et al.
5,113,946 A 5/1992 Cooper
5,145,014 A 9/1992 Eberhardt
5,158,614 A 10/1992 Takeuchi
5,174,383 A 12/1992 Haugen et al.
5,211,245 A 5/1993 Relyea et al.
5,232,052 A 8/1993 Arvidson et al.
5,301,756 A 4/1994 Relyea et al.
5,313,548 A 5/1994 Arvidson et al.
5,326,232 A 7/1994 McDonnel et al.
5,346,334 A 9/1994 Einaru et al.
5,368,317 A 11/1994 McCombs et al.
5,389,031 A 2/1995 Sharpe et al.
5,467,827 A 11/1995 McLoughlin
5,494,112 A 2/1996 Arvidson et al.
5,538,185 A 7/1996 Rabitsch et al.
5,538,274 A 7/1996 Schmitz et al.
5,553,673 A 9/1996 Hackman
5,617,696 A 4/1997 Young
5,746,396 A 5/1998 Thorton-Trump
5,765,644 A 6/1998 Arvidson et al.
5,785,372 A 7/1998 Glatzmeier et al.
5,788,158 A 8/1998 Relyea
5,820,150 A 10/1998 Archer et al.
5,826,663 A 10/1998 Sundholm
5,839,664 A 11/1998 Relyea
5,881,818 A 3/1999 Lee et al.
RE36,196 E 4/1999 Eberhardt
5,897,123 A 4/1999 Cherney et al.
5,899,276 A 5/1999 Relyea et al.
5,909,780 A 6/1999 De Andrade
6,006,841 A 12/1999 Hunke
6,009,953 A 1/2000 Laskaris et al.
6,105,984 A 8/2000 Schmitz et al.
6,155,351 A 12/2000 Breedlove et al.
6,161,643 A 12/2000 Bober et al.
6,193,007 B1 2/2001 Lie
6,220,532 B1 4/2001 Manon et al.
6,289,995 B1 9/2001 Fuller
6,394,534 B1 5/2002 Dean
6,421,593 B1 7/2002 Kempen et al.
6,516,914 B1 2/2003 Andersen et al.
6,520,494 B1 2/2003 Andersen et al.
6,553,290 B1 4/2003 Pillar
6,561,718 B1 5/2003 Archer et al.
6,588,286 B1 7/2003 Kudo et al.
6,598,702 B1 7/2003 McGillewie et al.
6,615,675 B1 9/2003 Kudo et al.
6,695,328 B2 2/2004 Cope
6,715,373 B2 4/2004 Kudo et al.
6,739,174 B2 5/2004 Kudo et al.
6,755,258 B1 6/2004 Hunke et al.
6,755,259 B2 6/2004 Peltola et al.
6,757,597 B2 6/2004 Yakes et al.
6,764,085 B1 7/2004 Anderson
6,769,733 B2 8/2004 Seksaria et al.
6,782,965 B2 8/2004 Sztykiel et al.
6,811,161 B1 11/2004 Anderson
6,860,332 B1 3/2005 Archer et al.
6,882,917 B2 4/2005 Pillar et al.
6,883,815 B2 4/2005 Archer
6,885,920 B2 4/2005 Yakes et al.
6,909,944 B2 6/2005 Pillar et al.
6,922,615 B2 7/2005 Pillar et al.
6,973,768 B2 12/2005 Samejima et al.
6,976,688 B2 12/2005 Archer et al.
6,993,421 B2 1/2006 Pillar et al.
7,006,902 B2 2/2006 Archer et al.
7,024,296 B2 4/2006 Squires et al.
7,055,613 B1 6/2006 Bissen et al.
7,055,880 B2 6/2006 Archer
7,072,745 B2 7/2006 Pillar et al.
7,080,694 B2 7/2006 Boyle
7,100,741 B2 9/2006 Wissler et al.
7,107,129 B2 9/2006 Rowe et al.
7,127,331 B2 10/2006 Pillar et al.
7,137,456 B2 11/2006 Moses
7,143,641 B2 12/2006 Palazzolo et al.
7,162,332 B2 1/2007 Pillar et al.
7,164,977 B2 1/2007 Yakes et al.
7,184,862 B2 2/2007 Pillar et al.
7,184,866 B2 2/2007 Squires et al.
7,201,255 B1 4/2007 Kreikemeier
7,213,872 B2 5/2007 Ronacher et al.
7,234,534 B2 6/2007 Froland et al.
7,254,468 B2 8/2007 Pillar et al.
7,274,976 B2 9/2007 Rowe et al.
7,277,782 B2 10/2007 Yakes et al.
7,290,457 B2 11/2007 Kudo et al.
7,293,478 B2 11/2007 Kudo et al.
7,302,320 B2 11/2007 Nasr et al.
7,308,968 B2 12/2007 Denison
7,331,586 B2 2/2008 Trinkner et al.
7,379,797 B2 5/2008 Nasr et al.
7,387,348 B2 6/2008 Archer et al.
7,389,826 B2 6/2008 Linsmeier et al.
7,392,122 B2 6/2008 Pillar et al.
7,412,307 B2 8/2008 Pillar et al.
7,439,711 B2 10/2008 Bolton
7,451,028 B2 11/2008 Pillar et al.

(56) References Cited

U.S. PATENT DOCUMENTS

| | | | |
|---|---|---|---|
| 7,513,315 | B2 | 4/2009 | Boyle et al. |
| 7,522,979 | B2 | 4/2009 | Pillar |
| 7,530,403 | B2 | 5/2009 | Cano |
| 7,555,369 | B2 | 6/2009 | Pillar et al. |
| 7,611,075 | B2 | 11/2009 | Relyea et al. |
| 7,689,332 | B2 | 3/2010 | Yakes et al. |
| 7,703,543 | B2 | 4/2010 | Waters et al. |
| 7,711,460 | B2 | 5/2010 | Yakes et al. |
| 7,715,962 | B2 | 5/2010 | Rowe et al. |
| 7,725,225 | B2 | 5/2010 | Pillar et al. |
| 7,729,831 | B2 | 6/2010 | Pillar et al. |
| 7,756,621 | B2 | 7/2010 | Pillar et al. |
| 7,784,554 | B2 | 8/2010 | Grady et al. |
| 7,792,618 | B2 | 9/2010 | Quigley et al. |
| 7,792,949 | B2 | 9/2010 | Tewari et al. |
| 7,835,838 | B2 | 11/2010 | Pillar et al. |
| 7,848,857 | B2 | 12/2010 | Nasr et al. |
| 7,874,373 | B2 | 1/2011 | Morrow et al. |
| 8,000,850 | B2 | 8/2011 | Nasr et al. |
| 8,095,247 | B2 | 1/2012 | Pillar et al. |
| 8,103,366 | B2 | 1/2012 | Gamble et al. |
| 8,201,656 | B2 | 6/2012 | Archer et al. |
| 8,215,241 | B2 | 7/2012 | Garneau et al. |
| 8,376,719 | B2 | 2/2013 | Grady et al. |
| 8,413,764 | B1 | 4/2013 | Cohen et al. |
| 8,555,625 | B2 | 10/2013 | Trinkner et al. |
| 8,739,892 | B2 | 6/2014 | Moore et al. |
| 8,789,614 | B2 | 7/2014 | Hosfield |
| 8,801,393 | B2 | 8/2014 | Crabtree et al. |
| 8,807,233 | B2 | 8/2014 | Peltola et al. |
| 8,839,902 | B1 | 9/2014 | Archer et al. |
| 9,008,913 | B1 | 4/2015 | Sears et al. |
| 9,061,168 | B2 | 6/2015 | Mikota et al. |
| 9,061,169 | B2 | 6/2015 | Linsmeier |
| 9,315,210 | B2 | 4/2016 | Sears et al. |
| 9,493,921 | B2 | 11/2016 | Amin et al. |
| 10,286,239 | B2 * | 5/2019 | Shively ..... A62C 31/22 |
| 2002/0117345 | A1 | 8/2002 | Sztykiel et al. |
| 2003/0158635 | A1 | 8/2003 | Pillar et al. |
| 2003/0163228 | A1 | 8/2003 | Pillar et al. |
| 2003/0195680 | A1 | 10/2003 | Pillar |
| 2003/0230414 | A1 | 12/2003 | Peltola et al. |
| 2004/0020262 | A1 | 2/2004 | Kudo et al. |
| 2004/0133319 | A1 | 7/2004 | Pillar et al. |
| 2004/0155426 | A1 | 8/2004 | Wen et al. |
| 2005/0099885 | A1 | 5/2005 | Tamminga |
| 2005/0196269 | A1 | 9/2005 | Racer et al. |
| 2005/0234622 | A1 | 10/2005 | Pillar et al. |
| 2005/0236226 | A1 | 10/2005 | Salmi et al. |
| 2005/0247524 | A1 | 11/2005 | Wissler et al. |
| 2006/0021764 | A1 | 2/2006 | Archer et al. |
| 2006/0022001 | A1 | 2/2006 | Linsmeier et al. |
| 2006/0032701 | A1 | 2/2006 | Linsmeier et al. |
| 2006/0032702 | A1 | 2/2006 | Linsmeier et al. |
| 2006/0070845 | A1 | 4/2006 | Crookston |
| 2006/0086566 | A1 | 4/2006 | Linsmeier et al. |
| 2006/0213672 | A1 | 9/2006 | Mohr |
| 2006/0266532 | A1 | 11/2006 | Moskun |
| 2007/0187434 | A1 | 8/2007 | Schrafel |
| 2007/0205053 | A1 | 9/2007 | Isham et al. |
| 2007/0246230 | A1 | 10/2007 | Roberts |
| 2007/0256842 | A1 | 11/2007 | Mohr |
| 2007/0284156 | A1 | 12/2007 | Grady et al. |
| 2007/0286736 | A1 | 12/2007 | Grady et al. |
| 2008/0035201 | A1 | 2/2008 | Roberts |
| 2008/0059030 | A1 | 3/2008 | Quigley et al. |
| 2008/0099212 | A1 | 5/2008 | Do |
| 2008/0099213 | A1 | 5/2008 | Morrow et al. |
| 2008/0103651 | A1 | 5/2008 | Pillar et al. |
| 2008/0215700 | A1 | 9/2008 | Pillar et al. |
| 2008/0236846 | A1 | 10/2008 | Gamble et al. |
| 2008/0271901 | A1 | 11/2008 | Decker |
| 2009/0101436 | A1 | 4/2009 | Burman et al. |
| 2009/0218108 | A1 | 9/2009 | Cano |
| 2010/0038098 | A1 | 2/2010 | Groonwald et al. |
| 2010/0044059 | A1 | 2/2010 | Mikota et al. |
| 2010/0065286 | A1 | 3/2010 | Hosfield |
| 2010/0200328 | A1 | 8/2010 | Savard et al. |
| 2011/0064591 | A1 | 3/2011 | McLoughlin et al. |
| 2012/0132445 | A1 | 5/2012 | Mallon et al. |
| 2012/0193109 | A1 | 8/2012 | Moore et al. |
| 2014/0048353 | A1 | 2/2014 | Ellis |
| 2014/0238704 | A1 | 8/2014 | Moore et al. |
| 2014/0334169 | A1 | 11/2014 | Ewert |
| 2015/0096835 | A1 | 4/2015 | Hong et al. |
| 2015/0120152 | A1 | 4/2015 | Lauterjung et al. |
| 2015/0246251 | A1 | 9/2015 | Mikota et al. |
| 2015/0273252 | A1 | 10/2015 | Lenz et al. |
| 2015/0273253 | A1 | 10/2015 | Lenz et al. |

FOREIGN PATENT DOCUMENTS

| | | |
|---|---|---|
| DE | 11 86 334 | 1/1965 |
| DE | 36 20 603 A1 | 1/1987 |
| DE | 36 40 944 A1 | 6/1988 |
| EP | 0 244 668 | 11/1987 |
| EP | 0 685 382 | 12/1995 |
| EP | 1 371 391 B1 | 12/2009 |
| FR | 1471914 | 3/1967 |
| FR | 2380176 | 9/1978 |
| GB | 2 168 015 | 6/1986 |
| JP | H11-239625 | 9/1999 |
| JP | 2000-107313 | 4/2000 |
| JP | 2008-297701 | 12/2008 |
| KR | 20110040306 | 4/2011 |
| KR | 101297477 | 8/2013 |
| WO | WO-01/76912 A1 | 10/2001 |
| WO | WO-03/049987 A2 | 6/2003 |
| WO | WO-2007/140179 A2 | 12/2007 |

* cited by examiner

FIRE APPARATUS PIERCING TIP RANGING AND ALIGNMENT SYSTEM

CROSS-REFERENCE TO RELATED PATENT APPLICATIONS

This application is a continuation of U.S. patent application Ser. No. 15/705,952, filed Sep. 15, 2017, which claims the benefit of U.S. Provisional Patent Application No. 62/456,440, filed Feb. 8, 2017, both of which are incorporated herein by reference in their entireties.

BACKGROUND

Fire-fighting vehicles, for example Aircraft Rescue Fire-Fighting (ARFF) vehicles, are specialized vehicles that carry water and foam with them to the scene of an emergency. Most commonly, ARFF vehicles are commissioned for use at an airfield, where the location of an emergency (e.g., an airplane crash, etc.) can vary widely, thereby prompting the transport of fire-fighting materials and personnel to the emergency site. ARFF vehicles are heavy-duty vehicles in nature and are able to respond at high speeds to reach even remote areas of an airfield quickly.

Aircraft fuselages are often configured to partially or completely seal their interior from their surroundings (e.g., to facilitate pressurization of a passenger cabin). Accordingly, conventional fire suppression methods (e.g., spraying water from a distance) can be ineffective when combatting a fire located on the interior of such a fuselage. To facilitate suppression of such fires, some ARFF vehicles are equipped with a penetrating nozzle mounted near an end of a boom assembly. The penetrating nozzle is configured to penetrate the fuselage of an airplane and supply fire suppressant (e.g., foam, water, etc.) to the interior of the fuselage. Due to the round shape of a typical aircraft fuselage, the penetrating nozzle may fail to penetrate the fuselage if aligned at a shallow angle relative to the exterior surface of the fuselage. Conventionally, the boom assembly and the penetrating nozzle are aligned manually by an operator located a distance away from the penetrating nozzle (e.g., in a cabin of the ARFF vehicle). The alignment may occur at night or in rain or snow, obstructing the operator's view of the penetrating nozzle. Additionally, manual operation of such penetrating nozzle requires significant training. Accordingly, operators often experience difficulty properly aligning a penetrating nozzle, causing delays during time-sensitive emergency situations and potential damage to the penetrating nozzle.

SUMMARY

One embodiment relates to a fire-fighting vehicle including a chassis, a boom assembly movably coupled to the chassis, a penetrating nozzle coupled to the boom assembly, an actuator configured to move the penetrating nozzle relative to the chassis, a sensor, and a controller configured to receive the sensor data. The penetrating nozzle includes a piercing tip extending along a longitudinal axis and an outlet configured to be selectively fluidly coupled to a supply of fire suppressant. The piercing tip is configured to be selectively repositioned relative to a surface of an object having an interior cavity. The outlet is positioned to supply fire suppressant into the interior cavity when the piercing tip is within the interior cavity of the object. The sensor is configured to provide sensor data relating to at least one of a position and an orientation of the piercing tip relative to a surface. The controller is configured to determine an angular orientation of the piercing tip relative to the surface of the object based on the sensor data.

Another embodiment relates to a control system for a fire-fighting vehicle including a first actuator configured to selectively reposition a boom assembly of the vehicle relative to a chassis of the vehicle, a second actuator configured to move a penetrating nozzle relative to the chassis, a sensor configured to provide sensor data relating to at least one of a position and an orientation of the piercing tip relative to a surface of an object, and a controller configured to receive the sensor data. The penetrating nozzle includes a piercing tip extending along a longitudinal axis and an outlet configured to be selectively fluidly coupled to a supply of fire suppressant. The controller is configured to determine an angular orientation of the piercing tip relative to the surface of the object based on the sensor data.

Yet another embodiment relates to a method of facilitating penetration of a penetrating nozzle through a surface of an object, including rotating the penetrating nozzle such that the penetrating nozzle sweeps through an angular range, measuring range data relating to a distance between a piercing tip of the penetrating nozzle and the surface at multiple angular positions throughout the angular range, and determining an angular orientation between the penetrating nozzle and the surface based on the range data.

BRIEF DESCRIPTION OF THE FIGURES

The invention will become more fully understood from the following detailed description, taken in conjunction with the accompanying drawings, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to an exemplary embodiment, a fire-fighting vehicle includes a chassis, a boom assembly movably coupled to the chassis, and a penetrating nozzle rotatably coupled to the boom assembly. The penetrating nozzle includes a piercing tip configured to penetrate a surface of an object (e.g., an aircraft fuselage, a building, etc.) and an outlet selectively fluidly coupled to a supply of fire suppressant. The fire-fighting vehicle is configured to penetrate the object with the penetrating nozzle and provide fire suppressant to an interior volume (e.g., a cabin, a room, etc.) of the object to suppress a fire within the interior volume. The fire-fighting vehicle further includes a nozzle alignment system that assists an operator in orienting the penetrating nozzle in an angular orientation relative to the surface where penetration of the surface is likely to succeed. The nozzle alignment system includes an actuator configured to rotate the penetrating nozzle relative to the boom assembly.

When aligning the penetrating nozzle, the actuator first sweeps the penetrating nozzle through a series of angular positions. As the penetrating nozzle rotates, a range sensor coupled to the penetrating nozzle is used to measure range data relating to a distance between the piercing tip and the surface in multiple different angular positions. Using the range data, the nozzle alignment system determines a target range of angular orientations relative to the surface for the penetrating nozzle. The target range includes the angular orientation where the distance between the piercing tip and the surface is smallest, as this is near or coincides with the point where the penetrating nozzle is perpendicular to the surface. Accordingly, with the penetrating nozzle in the target range, the penetrating nozzle is less likely to deflect off of the surface when attempting to penetrate the surface. The nozzle alignment system issues instructions (e.g., through a graphical display) to the operator to facilitate alignment of the penetrating nozzle within the target range (e.g., instructions to rotate the penetrating nozzle up or down using the actuator). After the penetrating nozzle is within the target range, the surface is penetrated, and fire suppressant is supplied to the interior volume.

Figure 1:
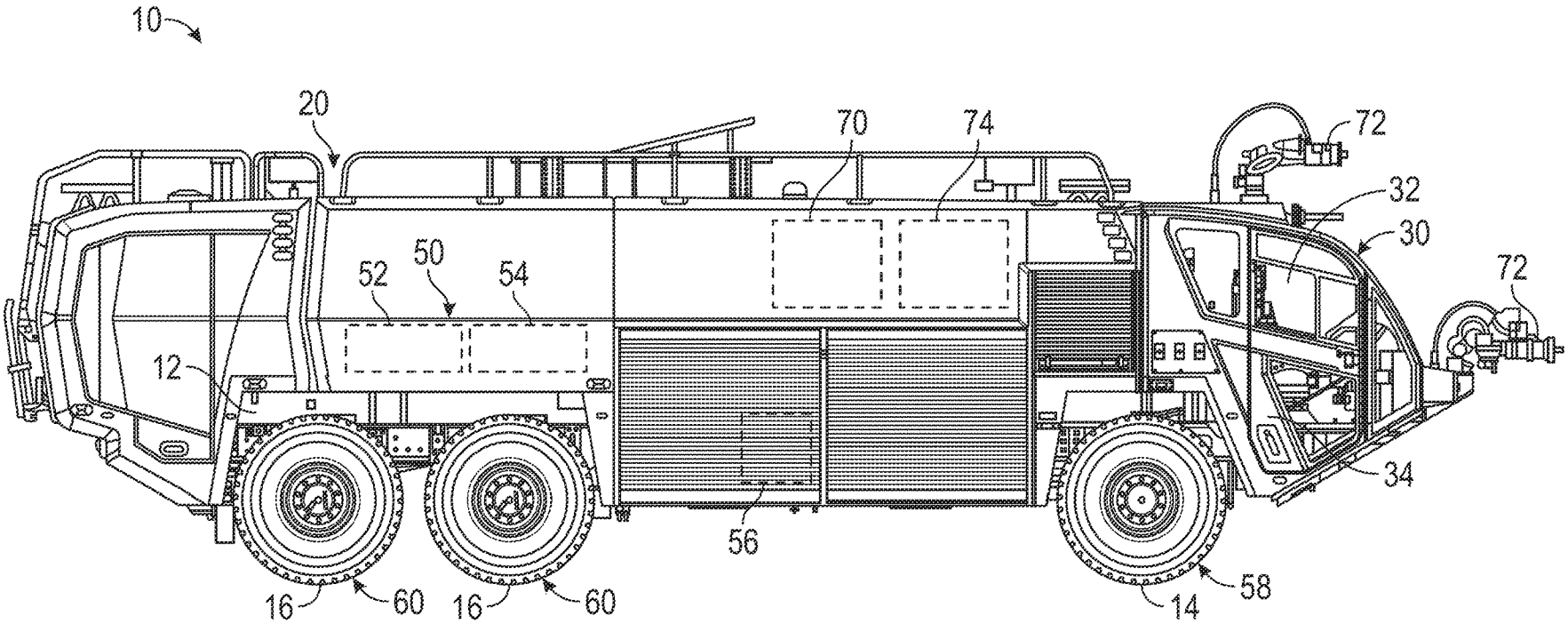
FIG. 1 is a side view of a fire-fighting vehicle, according to an exemplary embodiment.

According to the exemplary embodiment shown in FIG. 1, a vehicle, shown as fire-fighting vehicle 10, includes a chassis, shown as frame 12. Fire-fighting vehicle 10 may be an ARFF vehicle, a municipal fire-fighting vehicle, or still another type of fire-fighting vehicle. The frame 12 is supported by a plurality of tractive elements, shown as front wheels 14 and rear wheels 16. The frame 12 supports a body assembly, shown as a rear section 20, and a cab or front section, shown as front cabin 30. As shown in FIG. 1, the front cabin 30 is positioned forward of the rear section 20 (e.g., with respect to a forward direction of travel for the vehicle, etc.). According to an alternative embodiment, the cab is positioned behind the rear section 20 (e.g., with respect to a forward direction of travel for the vehicle, etc.). According to an exemplary embodiment, the front cabin 30 includes a plurality of body panels coupled to a support (e.g., a structural frame assembly, etc.). The body panels may define a plurality of openings through which an operator accesses (e.g., for ingress, for egress, to retrieve components from within, etc.) an interior 32 of front cabin 30. As shown in FIG. 1, the front cabin 30 includes a pair of doors 34 positioned over the plurality of openings defined by the plurality of body panels. The doors 34 provide access to the interior 32 of front cabin 30 for a driver (and/or passengers) of the fire-fighting vehicle 10.

As shown in FIG. 1, the fire-fighting vehicle 10 includes a powertrain, shown as powertrain 50, that includes a driver, shown as engine 52. The powertrain 50 is configured to propel the fire-fighting vehicle 10. The powertrain 50 may be coupled to the frame 12. According to an exemplary embodiment, the engine 52 is a compression-ignition internal combustion engine that utilizes diesel fuel. In alternative embodiments, the engine 52 is another type of driver (e.g., spark-ignition engine, fuel cell, electric motor, hybrid engine/motor, etc.) that is otherwise powered (e.g., with gasoline, compressed natural gas, hydrogen, electricity, etc.). As shown in FIG. 1, the powertrain 50 further includes a transmission, shown as transmission 54, and a transfer case, shown as transfer case 56. The transmission 54 may include one or more gear sets such that the transmission 54 has multiple gear ratios (e.g., to provide an output at different speeds, torques, etc. than that provided by the engine 52, etc.). Mechanical energy from the engine 52 may be transferred to the transfer case 56 through the transmission 54. The transfer case 56 provides mechanical energy to one or more front axles, shown in FIG. 1 as front axle assemblies 58, and to one or more rear axle axles, shown in FIG. 1 as rear axle assemblies 60. The front axle assemblies 58 may be connected to the front wheels 14, and the rear axle assemblies 60 may be connected to the rear wheels 16.

As shown in FIG. 1, the vehicle includes a pump 70. The pump 70 receives mechanical energy (e.g., from the engine 52, from another onboard driver, etc.) and is configured to provide (e.g., pump, etc.) fire suppressant, such as a fluid (e.g., water, etc.) and/or an agent (e.g., foam, etc.), at an increased pressure to facilitate extinguishing a fire. The pump 70 may be any type of pump that pressurizes fluid (e.g., a centrifugal pump, a fixed displacement pump, a variable displacement pump, etc.). As shown in FIG. 1, the fire-fighting vehicle 10 includes nozzles, shown as body nozzles 72, fluidly coupled to an output of the pump 70. In one embodiment, the body nozzles 72 are configured to direct the pressurized fire suppressant towards a fire. As shown in FIG. 1, the fire-fighting vehicle 10 includes a tank 74. In other embodiments, the fire-fighting vehicle 10 includes multiple tanks 74. The one or more tanks 74 are fluidly coupled to an inlet of the pump 70 and are configured to contain a volume of fire suppressant. In some embodiments, the pump 70 receives fire suppressant at a low pressure from an outside source (e.g., a tanker truck, a body of water, etc.). In some embodiments, the fire-fighting vehicle 10 receives fire suppressant at a high pressure from an outside source (e.g., a tanker truck, a fire hydrant, etc.) and directs the pressurized fire suppressant out of the body nozzles 72 and/or a nozzle assembly (e.g., the nozzle assembly 200) of the fire-fighting vehicle 10. In some embodiments, the fire-fighting vehicle 10 does not include pump 70.

Figure 2:
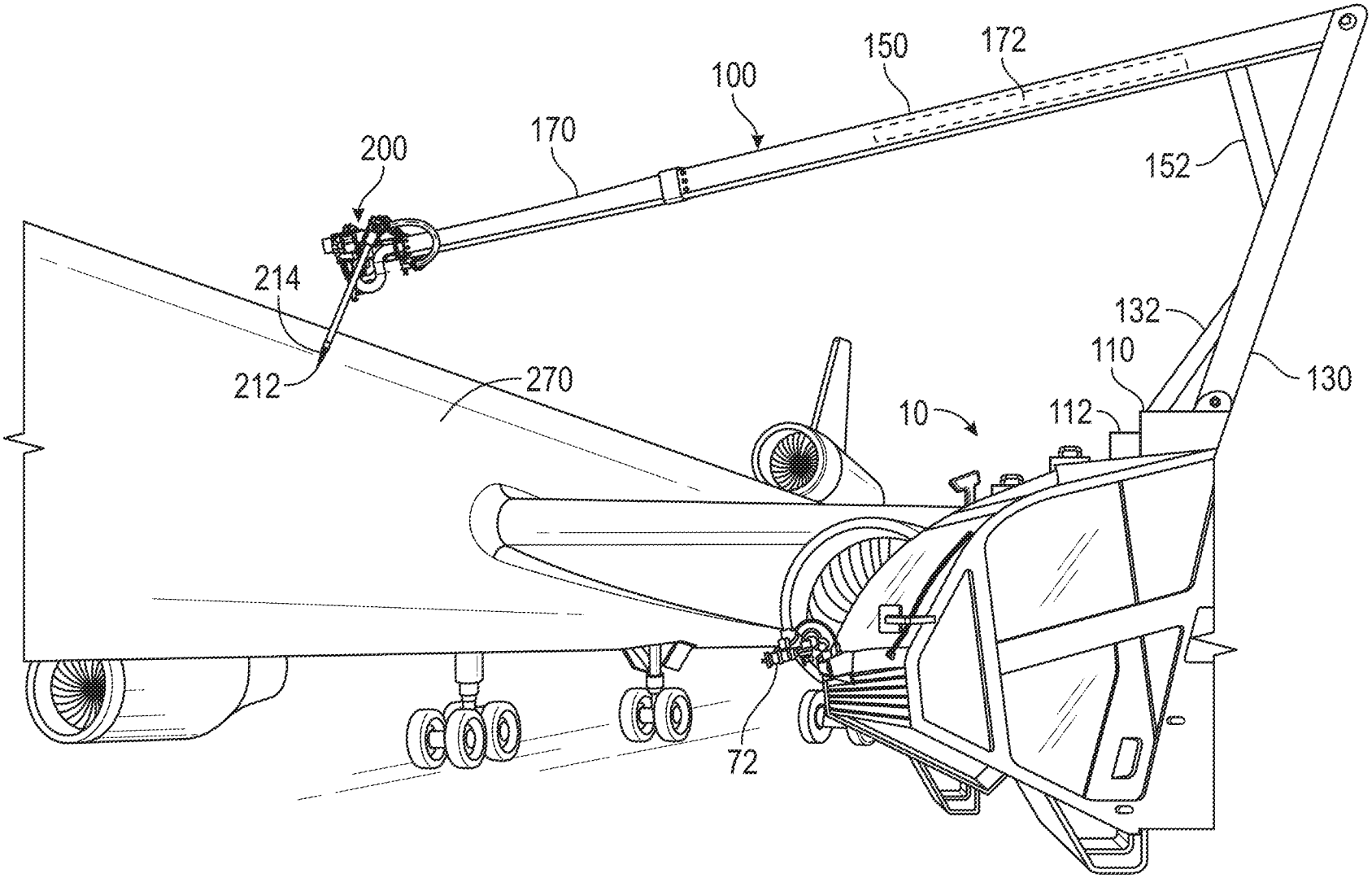
FIG. 2 is a perspective view of a fire-fighting vehicle including a boom assembly and a nozzle assembly, according to an exemplary embodiment.

As shown in FIG. 2, the fire-fighting vehicle 10 includes a boom assembly 100 and a nozzle assembly 200. In one embodiment, the boom assembly 100 facilitates positioning (e.g., by an operator, etc.) the nozzle assembly 200 (e.g., relative to the frame 12, relative to an aircraft fuselage, relative to the ground, etc.). As shown in FIG. 2, the boom assembly 100 is disposed along a top surface (e.g., a roof, etc.) of the rear section 20 and the front cabin 30 and is movably coupled to the frame 12. In other embodiments, the boom assembly 100 is coupled to the fire-fighting vehicle 10 elsewhere (e.g., along the sides, along the rear end, etc.).

As shown in FIG. 2, the boom assembly 100 includes a turntable, shown as turntable 110, disposed along a roof of the rear section 20 and the front cabin 30 and coupled (e.g., directly or indirectly) to the frame 12. In other embodiments, the turntable 110 is omitted and the boom assembly 100 is coupled to and disposed along an intermediate structural frame. In still other embodiments, the turntable 110 is omitted and the boom assembly 100 is directly coupled to the roof. The turntable 110 facilitates rotation of the boom assembly 100 relative to the rear section 20 and the front cabin 30 (e.g., about a vertical axis, about an approximately vertical axis, etc.). In some embodiments, the turntable 110 is spaced from a surface (e.g., an outermost surface, an uppermost surface, etc.) of the roof.

As shown in FIG. 2, the turntable 110 includes an actuator, shown as turntable actuator 112, that is configured to rotate the turntable 110. The turntable actuator 112 may be an electric motor, a hydraulic actuator (e.g., a cylinder, a motor, etc.), a pneumatic actuator, or still another actuator or device. In some embodiments, the turntable 110 is rotatable 360 degrees or more (i.e., fully rotatable). In other embodiments, the turntable 110 is rotatable within a window of less than 360 degrees.

As shown in FIG. 2, a boom section, shown as base boom section 130, has a proximal end that is pivotably coupled to the turntable 110. The base boom section 130 may be rotatable relative to the frame 12 (e.g., about a horizontal axis, etc.). As shown in FIG. 2, the boom assembly 100 includes an actuator, shown as base actuator 132, that is configured to rotate the base boom section 130 (e.g., about the horizontal axis, etc.). The base actuator 132 may be an electric motor, a hydraulic actuator, a pneumatic actuator, or still another actuator or device. By way of example, the base actuator 132 may be a hydraulic cylinder pivotably coupled to the turntable 110 and the base boom section 130. In one such example, extension of the base actuator 132 may lift the base boom section 130, and retraction of the base actuator 132 may lower the base boom section 130.

As shown in FIG. 2, a boom section, shown as upper boom section 150, is pivotably coupled to a distal end of the base boom section 130. The upper boom section 150 may be rotatable relative to the base boom section 130 (e.g., about a horizontal axis, etc.). As shown in FIG. 2, the boom assembly 100 includes an actuator, shown as upper actuator 152, that is configured to rotate the upper boom section 150 relative to the base boom section 130. The upper actuator 152 may be an electric motor, a hydraulic actuator, a pneumatic actuator, or still another actuator or device. By way of example, the upper actuator 152 may be a hydraulic cylinder pivotably coupled to the base boom section 130 and the upper boom section 150. In one such example, extension of the upper actuator 152 lifts the upper boom section 150, and retraction of the upper actuator 152 lowers the upper boom section 150.

As shown in FIG. 2, a boom section, shown as telescoping boom section 170, is translatably coupled to the upper boom section 150. In some embodiments, the telescoping boom section 170 is located partially within the upper boom section 150. The telescoping boom section 170 is translatable relative to the upper boom section 150 about a longitudinal axis of the upper boom section 150. The boom assembly 100 includes an actuator, shown as telescoping actuator 172, that is configured to extend and retract the telescoping boom section 170 relative to the upper boom section 150. The telescoping actuator 172 may be an electric motor, a hydraulic actuator, a pneumatic actuator, or still another actuator or device. By way of example, the telescoping actuator 172 may be a hydraulic cylinder coupled to the upper boom section 150 and the telescoping boom section 170. Extension of the telescoping actuator 172 may pay out the telescoping boom section 170 from the upper boom section 150 (i.e., extend the telescoping boom section 170), and retraction of the telescoping actuator 172 may withdraw the telescoping boom section 170 relative to (e.g., into, etc.) the upper boom section 150 (i.e., retract the telescoping boom section 170).

Figure 3:
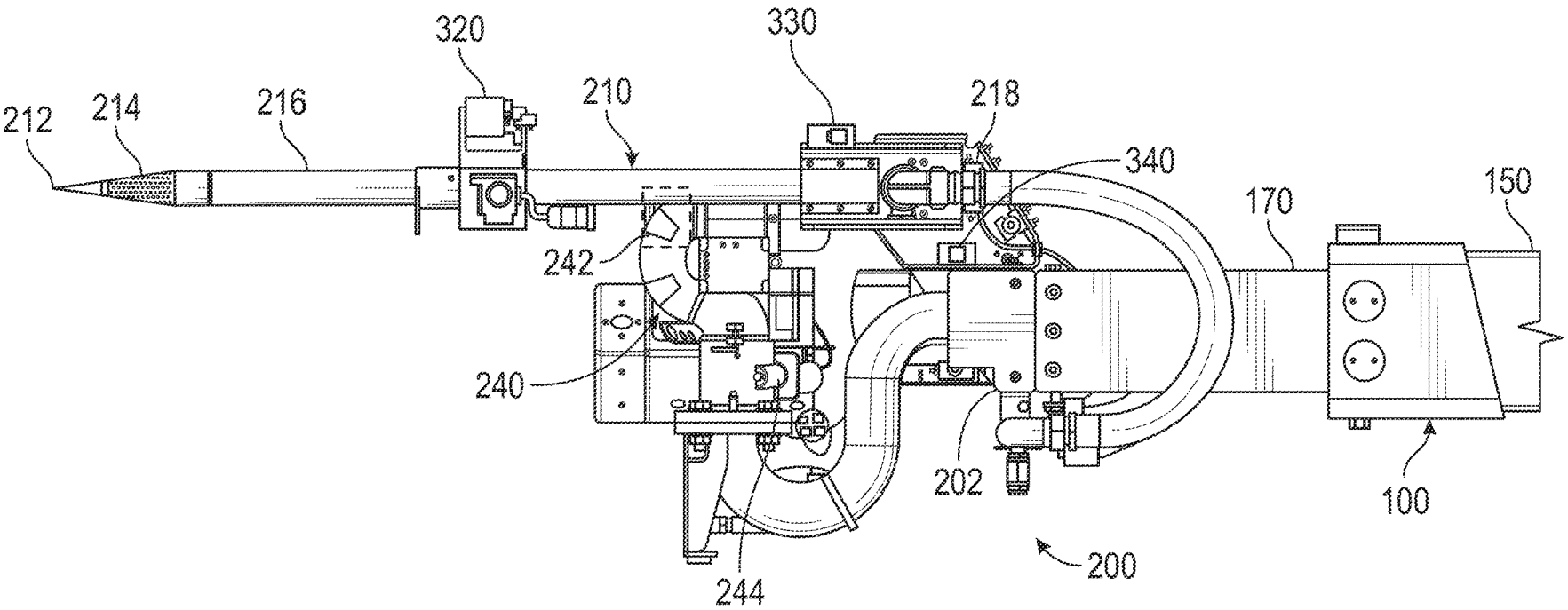
FIG. 3 is a side view of the nozzle assembly and the boom assembly of FIG. 2.

As shown in FIG. 3, the nozzle assembly 200 is coupled to a distal end of the boom assembly 100. As shown in FIG. 3, the nozzle assembly 200 includes a body, shown as nozzle assembly body 202, that is coupled (e.g., fixedly coupled) to the telescoping boom section 170. Engagement of the turntable actuator 112, the base actuator 132, the upper actuator 152, and/or the telescoping actuator 172 moves the nozzle assembly 200 (e.g., relative to the ground, relative to other portions of the fire-fighting vehicle 10, etc.).

As shown in FIG. 3, the nozzle assembly 200 includes a penetrating nozzle assembly or piercing nozzle assembly, shown as penetrating nozzle 210. The penetrating nozzle 210 may be used to suppress fires on the inside of an enclosed or semi-enclosed space (e.g., within a vehicle, within a building, etc.). By way of example, if a fire breaks out inside of the cabin of an aircraft, the penetrating nozzle 210 may be used to penetrate the fuselage of the aircraft and spray fire suppressant inside of the cabin to suppress the fire. By way of another example, the penetrating nozzle 210 may be used to penetrate the roof of a building and suppress a fire within a room thereof. As shown in FIG. 3, the penetrating nozzle 210 includes a tip, shown as piercing tip 212, an outlet portion or manifold, shown as outlet portion 214, and a body, shown as piercing body 216. The piercing tip 212, the outlet portion 214, and the piercing body 216 all extend along (e.g., are centered about, extend parallel to, etc.) the same axis (e.g., the longitudinal axis 276). The piercing tip 212 may have various cross-sectional shapes (e.g., circular, elliptical, square, rectangular, etc.). The piercing tip 212 may taper into a pointed end. As shown in FIG. 3, the piercing tip 212 is conical and extends from the outlet portion 214 to define a sharpened point. The pointed end of the piercing tip 212 facilitates piercing a surface (e.g., an airplane fuselage, a roof, a window, a wall, etc.). In some embodiments, the end of the piercing tip 212 has a radius of curvature (e.g., 0.01", 0.1", 0.25", etc.) that facilitates piercing a surface. In other embodiments, the end of the piercing tip 212 includes a frustum. By way of example, the end of the piercing tip 212 may be disposed within a plane to which the longitudinal axis 276 is orthogonal. The very end of the piercing tip 212 may be removed such that the end of the piercing tip 212 is disposed within the plane to which the longitudinal axis 276 is orthogonal. In some embodiments, the end of the piercing tip 212 includes a recess (e.g., a countersink, etc.). By way of example only, the recess may be formed by machining (e.g., drilling, etc.) into the end of the piercing tip 212. The tapered end of the piercing tip 212 and the recess may cooperate to define an edge at the end of the piercing tip 212. The piercing tip 212 having an edge may reduce slippage between the piercing tip 212 and the surface to be pierced upon engagement between the piercing tip 212 and the surface to be pierced. In some embodiments, the piercing tip 212 is configured to be harder than the surfaces it is intended to pierce (e.g., is manufactured from a relatively hard material, is heat treated, etc.) to reduce the risk of deforming the piercing tip 212. The piercing tip 212 may be harder than the outlet portion 214 and/or the piercing body 216.

Referring again to FIG. 3, the piercing tip 212 is coupled to the outlet portion 214, and the outlet portion 214 is tapered to match a taper of the piercing tip 212. The outlet portion 214 defines one or more outlets that are at least selectively (e.g., selectively, permanently, etc.) fluidly coupled to a supply of fire suppressant, such as an output of the pump 70, such that the outlets receive pressurized fire suppressant. The outlets are positioned near the piercing tip 212 such that the outlets can supply fire suppressant into an interior cavity of an object when the piercing tip 212 is in a position within the interior cavity. In some embodiments, one or more valves are disposed between the outlet portion 214 and the pump 70 and are configured to control the flow of fire suppressant to and out of the outlet portion 214. In one embodiment, the outlet portion 214 is coupled to a distal end of the piercing body 216. In some embodiments, the piercing tip 212 itself defines one or more outlets at least selectively fluidly coupled to a supply of fire suppressant.

As shown in FIG. 3, the penetrating nozzle 210 includes an actuator, shown as nozzle actuator 218. The nozzle actuator 218 is coupled to the penetrating nozzle 210 and to the nozzle assembly body 202 and is configured to move (e.g., rotate, reorient, etc.) the penetrating nozzle 210 relative to the nozzle assembly body 202 (e.g., about a vertical axis, about a horizontal axis extending perpendicular to the plane of FIG. 3, etc.). The nozzle actuator 218 may be an electric motor, a hydraulic actuator, a pneumatic actuator, or still another actuator or device.

As shown in FIG. 3, the nozzle assembly 200 further includes a second nozzle assembly, shown as spraying nozzle assembly 240. The spraying nozzle assembly 240 may be used to suppress fires outside the enclosed or semi-enclosed space (e.g., on the exterior of a structure such as a building, one the exterior of an aircraft, etc.). By way of example, the boom assembly 100 may be used to bring the spraying nozzle assembly 240 above, to the side of, or otherwise adjacent an aircraft. The spraying nozzle assembly 240 may facilitate spraying fire suppressant onto a fire to suppress it from a distance. In some embodiments, the maximum flow rate of fire suppressant through the spraying nozzle assembly 240 is greater than the maximum flow rate of fire suppressant through the penetrating nozzle 210. As shown in FIG. 3, the spraying nozzle assembly 240 includes a nozzle, shown as spraying nozzle 242, that is selectively fluidly coupled to the output of the pump 70. As shown in FIG. 3, the spraying nozzle assembly 240 includes a valve, shown as spraying nozzle valve 244, configured to control the flow of fire suppressant to the spraying nozzle 242. In some embodiments, the spraying nozzle assembly 240 is selectively repositionable relative to the nozzle assembly body 202. In some such embodiments, the nozzle assembly 200 includes an actuator configured to selectively reposition the spraying nozzle 242, thereby facilitating control over the direction of the spray from the spraying nozzle 242. In other embodiments, the nozzle assembly 200 does not include the spraying nozzle assembly 240.

Figure 4:
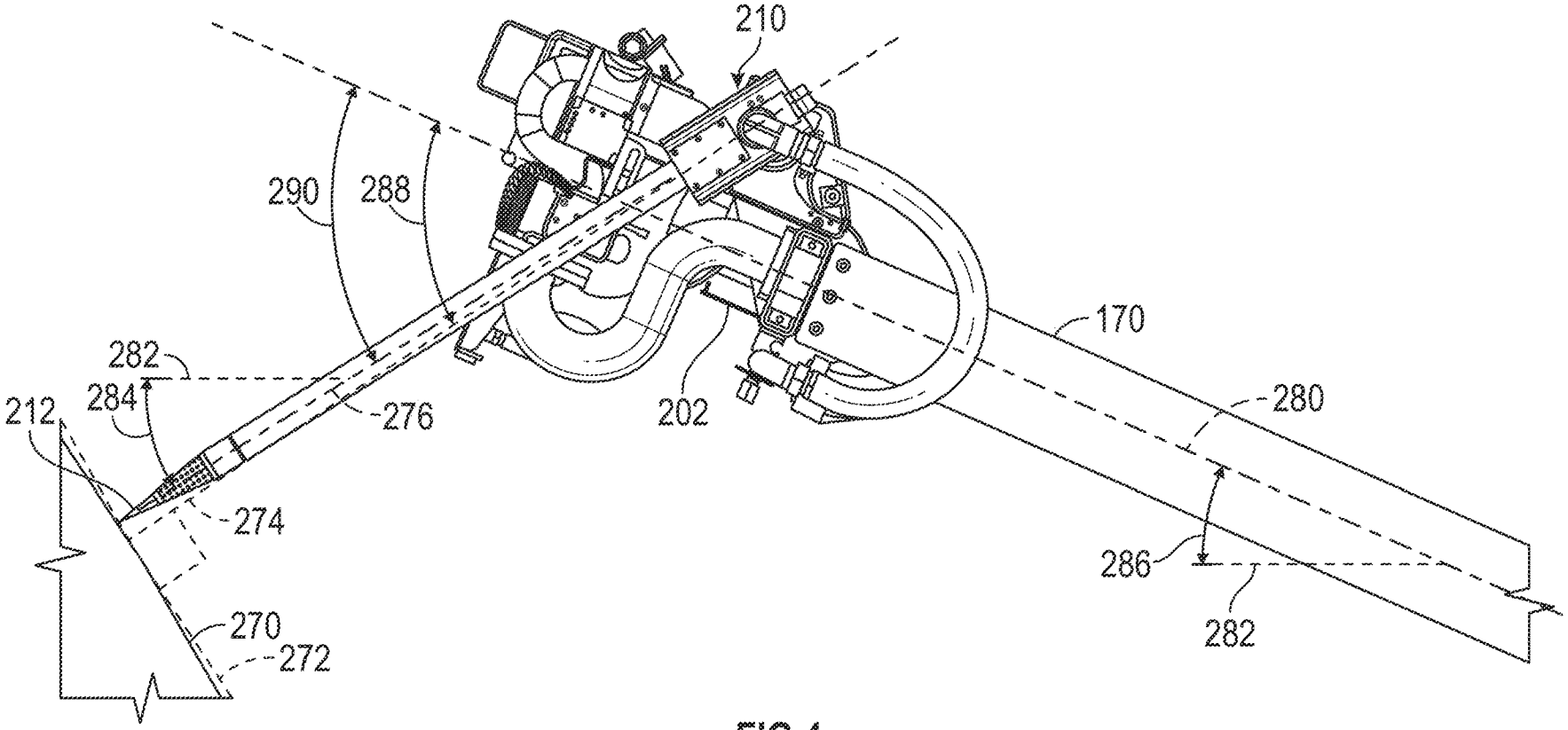
FIG. 4 is a schematic view of the nozzle assembly and the boom assembly of FIG. 2.

FIG. 4 illustrates the spatial relationships of the penetrating nozzle 210, the telescoping boom section 170, and a surface 270 to be penetrated by the penetrating nozzle 210. The surface 270 may be defined by a portion of an aircraft fuselage, the roof of a building, a window, a wall, or another type of structure or object. As shown in FIG. 4, the surface 270 is arcuate (e.g., circular, curved, etc.) and convex relative to the penetrating nozzle 210. It should be understood, however, that the surface 270 may be otherwise shaped (e.g., flat, concave, etc.). The systems and methods described herein may desirably facilitate orienting the penetrating nozzle 210 perpendicular (i.e., normal) to the surface 270 (e.g., about at least one axis) at a point of contact between the piercing tip 212 and the surface 270 (e.g., perpendicular within a threshold deviation or target range, etc.). Such an alignment reduces the risk of the piercing tip 212 deflecting off of the surface 270 when attempting to pierce the surface 270 compared to alignments with more shallow angles between the surface 270 and the penetrating nozzle 210.

Referring still to FIG. 4, line 272 is tangent to the surface 270 at the point of contact. In situations where the surface 270 is flat, line 272 is parallel to the surface 270. Line 274 is perpendicular to line 272 and represents a target or desired orientation of longitudinal axis 276 of the piercing tip 212 relative to the surface 270 when piercing the surface 270. Longitudinal axis 280 represents the longitudinal axis of the telescoping boom section 170 such that the telescoping boom section 170 extends and retracts along (e.g., parallel to) the longitudinal axis 280. Lines 282 represent lines parallel to a horizontal plane (e.g., parallel to the ground, perpendicular to the direction of gravity, etc.). The telescoping actuator 172 may be used to impart a force on the telescoping boom section 170 along the longitudinal axis 280 to pierce the surface 270. The systems and methods described herein may facilitate orienting the longitudinal axis 276 relative to the longitudinal axis 280 (e.g., exactly, within a threshold deviation or target range, etc.) to maximize the force from the telescoping actuator 172 that is directed along the longitudinal axis 276. Alternatively, the base actuator 132 and/or the upper actuator 152 may be used to impart a force perpendicular or approximately perpendicular to the longitudinal axis 280. In such embodiments, the systems and methods described herein facilitate orienting the longitudinal axis 276 relative to the longitudinal axis 280 to maximize the force from the base actuator 132 and/or the upper actuator 152 that is directed along the longitudinal axis 276. Angle 284 is measured between line 282 and longitudinal axis 276. Angle 286 is measured between line 282 and longitudinal axis 280. Angle 288 is measured between longitudinal axis 280 and line 274. Angle 290 is measured between longitudinal axis 280 and longitudinal axis 276. The systems and methods described herein may determine and employ angle 284, angle 286, angle 288, and/or angle 290 to determine the amount of force that will be directed into the penetrating nozzle 210 along the longitudinal axis 276.

Figure 5:
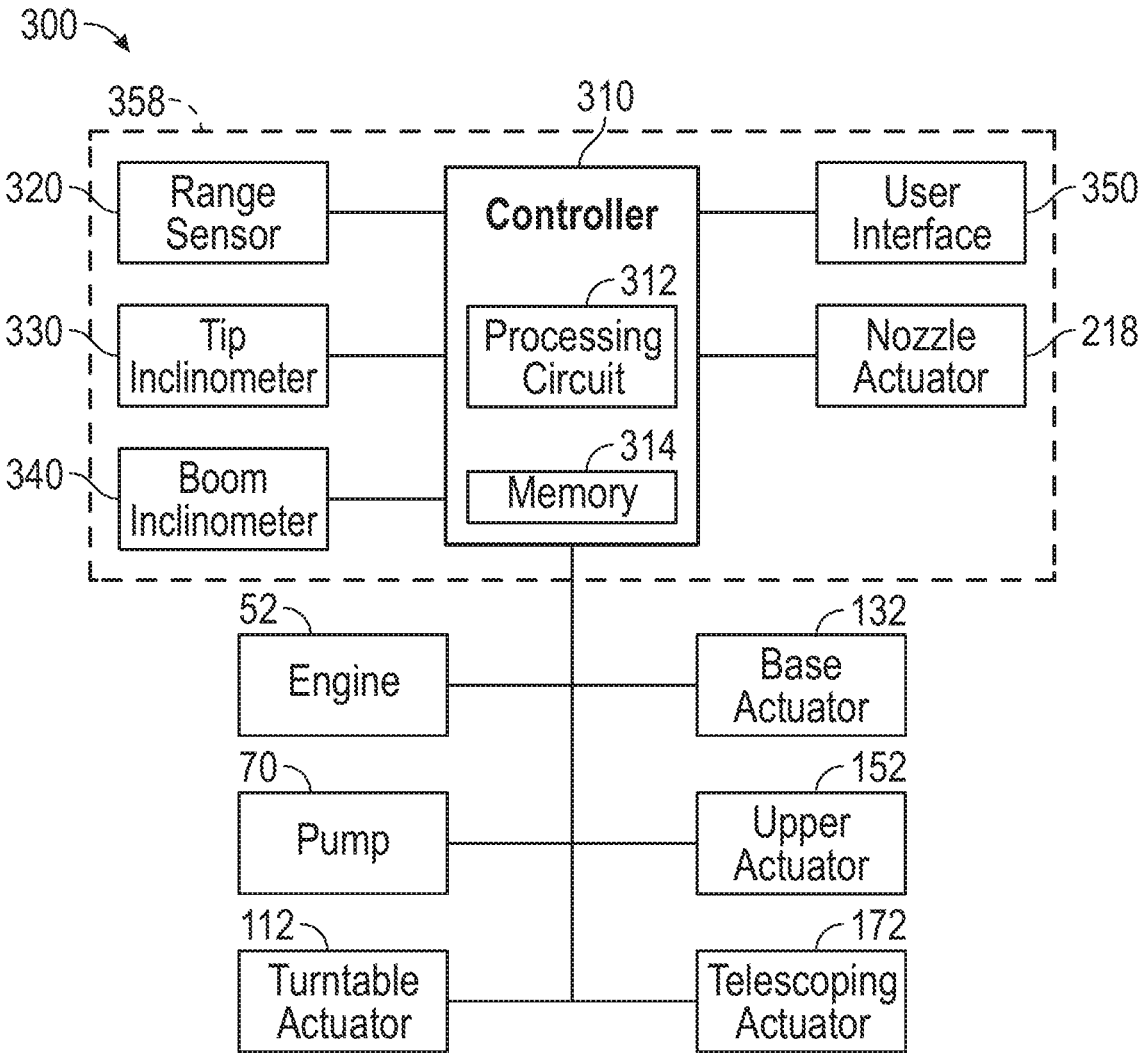
FIG. 5 is a block diagram of a control system for a fire-fighting vehicle, according to an exemplary embodiment.

According to the exemplary embodiment shown in FIG. 5, a control system 300 for a vehicle (e.g., the fire-fighting vehicle 10, etc.) includes a controller 310. In one embodiment, the controller 310 is configured to selectively engage, selectively disengage, control, or otherwise communicate with components of the fire-fighting vehicle 10 according to various modes of operation. As shown in FIG. 5, the controller 310 is operatively coupled to the engine 52, the pump 70, the turntable actuator 112, the base actuator 132, the upper actuator 152, the telescoping actuator 172, the nozzle actuator 218, a range sensor 320, a tip inclinometer 330, a boom inclinometer 340, and a user interface 350. The controller 310 may be configured to selectively control the speed and/or torque of the engine 52 (e.g., interface with a throttle of, etc.) and/or the actuation of the turntable actuator 112, the base actuator 132, the upper actuator 152, the telescoping actuator 172, and/or the nozzle actuator 218 (e.g., by interfacing with a valve controlling the flow of hydraulic fluid thereto, etc.). The controller 310 may send signals to and/or receive signals from any component of the control system 300. In an alternative embodiment, the controller 310 is operatively coupled to the range sensor 320, the tip inclinometer 330, the boom inclinometer 340, and the user interface 350. However, the other components (e.g., the actuators, the engine 52, the pump 70, etc.) are controlled by another controller (e.g., an electronic controller, by an operator utilizing manual controls, etc.).

The controller 310 may be implemented as a general-purpose processor, an application specific integrated circuit (ASIC), one or more field programmable gate arrays (FP- GAs), a digital-signal-processor (DSP), circuits containing one or more processing components, circuitry for supporting a microprocessor, a group of processing components, or other suitable electronic processing components. According to the exemplary embodiment shown in FIG. 5, the controller 310 includes a processing circuit 312 and a memory 314. Processing circuit 312 may include an ASIC, one or more FPGAs, a DSP, circuits containing one or more processing components, circuitry for supporting a microprocessor, a group of processing components, or other suitable electronic processing components. In some embodiments, processing circuit 312 is configured to execute computer code stored in memory 314 to facilitate the activities described herein. Memory 314 may be any volatile or non-volatile computer-readable storage medium capable of storing data or computer code relating to the activities described herein. According to an exemplary embodiment, memory 314 includes computer code modules (e.g., executable code, object code, source code, script code, machine code, etc.) configured for execution by processing circuit 312. Memory 314 includes various actuation profiles corresponding to modes of operation (e.g., for the engine 52, for the turntable actuator 112, the base actuator 132, the upper actuator 152, and the telescoping actuator 172, for the fire-fighting vehicle 10, etc.), according to an exemplary embodiment. In some embodiments, controller 310 may represent a collection of processing devices (e.g., servers, data centers, etc.). In such cases, processing circuit 312 represents the collective processors of the devices, and memory 314 represents the collective storage devices of the devices.

As shown in FIG. 3, the nozzle assembly 200 includes a distance sensor, shown as range sensor 320. The range sensor 320 is configured to sense a distance between (e.g., provide range data relating to the distance between, etc.) the range sensor 320 and an object or surface (e.g., the surface 270, etc.) that is disposed forward of the range sensor 320. The range sensor 320 may be an ultrasonic sensor, a laser rangefinder, or another type of sensor or device. As shown in FIG. 3, the range sensor 320 is coupled to the piercing body 216 and is thereby positioned to provide range data to the controller 310 relating to a distance from the piercing tip 212 to the surface 270. Because the range sensor 320 is coupled to the piercing body 216, the range sensor 320 continues to provide the range data even as the penetrating nozzle 210 rotates. Such a placement further facilitates providing range data even when the piercing tip 212 has penetrated beyond the surface 270. In some embodiments, the controller 310 is configured to use geometric relationships within the nozzle assembly 200 (e.g., a distance from the range sensor 320 to the piercing tip 212) stored in the memory 314 to determine the distance between the piercing tip 212 and the surface 270 from the range data. In other embodiments, the range sensor 320 is located elsewhere on the penetrating nozzle 210.

As shown in FIG. 3, the nozzle assembly 200 includes angle sensors, shown as tip inclinometer 330 and boom inclinometer 340. The tip inclinometer 330 and the boom inclinometer 340 may be any type of sensor configured to measure an inclination (e.g., an orientation with respect to the direction of gravity, etc.). As shown in FIG. 3, the tip inclinometer 330 is coupled to the piercing body 216. The tip inclinometer 330 may provide angle data relating to the angle 284, shown in FIG. 4, to the controller 310. As shown in FIG. 3, the boom inclinometer 340 is coupled to the nozzle assembly body 202. The boom inclinometer 340 may provide angle data relating to the angle 286, shown in FIG. 4, to the controller 310. Due to the geometric relationships between the angle 284, the angle 286, and the angle 290 (e.g., that the angle 290 is the sum of the angle 284 and the angle 286), the angle data from the tip inclinometer 330 and the boom inclinometer 340 relate to the angle 290. In some embodiments, the tip inclinometer 330 and/or the boom inclinometer 340 are located elsewhere on the nozzle assembly 200. Alternatively, the tip inclinometer 330 and the boom inclinometer 340 may be replaced with one or more angle sensors (e.g., potentiometers, optical encoders, etc.) that measure a relative angle between one or more components of the frame 12, the boom assembly 100, and the nozzle assembly 200. In such an embodiment, the angle sensor may provide angle data relating to the angle 290 directly. In either arrangement, the angle sensors provide angle data to the controller 310 that may be used to determine the relative angular orientations between one or more of the penetrating nozzle 210, the sections of the boom assembly 100, and the frame 12.

The range data and angle data may be acquired at multiple different angular positions of the penetrating nozzle 210. The controller 310 may be configured to generate a profile or map of the surface 270 from this range data and angle data. By way of example, the nozzle actuator 218 may rotate the penetrating nozzle 210, and the range sensor 320 and the tip inclinometer 230 may provide range data and angle data corresponding to multiple different angular positions of the penetrating nozzle 210. Using the range data, the angle data, and the geometry of the nozzle assembly 200, the controller 310 may calculate a profile of the surface 270 relative to the location and the orientation of the penetrating nozzle 210 and/or the piercing tip 212. Accordingly, the range data and the angle data relate to a position and an orientation of the penetrating nozzle 210 and/or the piercing tip 212 relative to the surface 270.

As shown in FIG. 5, the control system 300 further includes a user interface, shown as user interface 350. The user interface 350 may be located within the interior 32 of the front cabin 30. The user interface 350 includes a monitor (e.g., the monitor 360) that provides a representation of a graphic display (e.g., the graphical display 361) provided by the controller 310. In some embodiments, the monitor includes buttons and/or a touchscreen to facilitate interaction with the control system 300 by an operator. In some embodiments, the user interface 350 includes touchscreens, a steering wheel, a brake pedal, an accelerator pedal, and various controls (e.g., buttons, switches, knobs, levers, etc.), among other components. The user interface 350 may facilitate operator control of the fire-fighting vehicle 10 (e.g., direction of travel, speed, etc.), the pump 70 (e.g., a pump flow rate, a flow control valve, etc.), the boom assembly 100 (e.g., control of the actuation of the turntable actuator 112, the base actuator 132, the upper actuator 152, and/or the telescoping actuator 172), the nozzle assembly 200 (e.g., the nozzle actuator 218, the spraying nozzle valve 244, etc.) and/or still other components of the fire-fighting vehicle 10 from within the front cabin 30.

The systems and methods outlined herein facilitate aligning the penetrating nozzle 210 with the surface 270, despite depth perception challenges (e.g., due to the distance between the penetrating nozzle 210 and the front cabin 30), obstructed views, or environmental challenges (e.g., rain, snow, etc.) operators may face. As shown in FIG. 5, the control system 300 includes a surface detection and nozzle alignment system, shown as nozzle alignment system 358. The nozzle alignment system 358 includes the nozzle actuator 218, the controller 310, the range sensor 320, the tip inclinometer 330, the boom inclinometer 340, and the user interface 350. The nozzle alignment system 358 is configured to assist the operator in aligning the penetrating nozzle 210 with the surface 270. In some embodiments, the penetrating nozzle 210 is considered to be aligned with the surface 270 when the penetrating nozzle 210 is within a target range of angular orientations relative to the surface 270. The controller 310 may be configured to set the target range to include the angular orientation in which the distance between the piercing tip 212 and the surface 270 is smallest (i.e., the desired orientation) and a range of angular orientations surrounding it (e.g., a tolerance surrounding the desired orientation). The desired orientation and the orientations immediately surrounding it have an elevated likelihood of successfully penetrating a curved surface (e.g., are less likely to deflect off of a curved surface than other orientations) due to the steep angle between the penetrating nozzle 210 and the surface 270. The nozzle alignment system 358 facilitates consistent penetration of the object regardless of how difficult it may otherwise be to align the penetrating nozzle 210 manually (e.g., due to environmental factors such as rain or snow, due to lack of operator training, due to the distance between the nozzle assembly 200 and the front cabin 30, etc.).

The nozzle alignment system 358 may be configured to interact with the range sensor 320 and/or the tip inclinometer 330 to facilitate aligning the longitudinal axis 276 of the penetrating nozzle 210 within the target range. In some embodiments, the operator controls the boom assembly 100 (e.g., using the turntable actuator 112, the base actuator 132, the upper actuator 152, and/or the telescoping actuator 172, etc.) to bring the penetrating nozzle 210 near the surface 270 prior to alignment. In some embodiments, the operator manually aligns the penetrating nozzle 210 within a target range about a first axis (e.g., a vertical axis). By way of example, the operator may align the penetrating nozzle 210 about a vertical axis by controlling the turntable actuator 112 and using the boom assembly 100 as a visual guide. In such embodiments, the nozzle alignment system 358 is used to align the piercing nozzle within a target range about a second axis (e.g., a horizontal axis). Alternatively, the nozzle alignment system 358 may be used to align the penetrating nozzle 210 about multiple axes. In such embodiments, the nozzle alignment system 358 may be used to align the penetrating nozzle 210 about a first axis (e.g., a vertical axis) prior to aligning the penetrating nozzle 210 about a second axis (e.g., a horizontal axis). Accordingly, in such embodiments, the controller 310 may determine two target ranges of angular orientations relative to the surface 270: one target range defined about the first axis and one target range defined about the second axis.

The controller 310 is configured to control the nozzle actuator 218 to sweep (e.g., rotate up and down, rotate left and right, etc.) the penetrating nozzle 210 over the surface 270 through an angular range (e.g., a range of angular positions). Alternatively, the controller 310 may be configured to control one of the actuators of the boom assembly 100 (e.g., the turntable actuator 112, the upper actuator 152, etc.) to sweep the penetrating nozzle 210. The angular range may be a predetermined range (e.g., from horizontal to 45 degrees above horizontal, etc.), may be set by an operator (e.g., the operator controls actuation of the nozzle actuator 218 using a joystick operatively coupled to the controller 310, etc.), may be based on the range data from the range sensor 320 (e.g., the penetrating nozzle 210 is moved until the range sensor 320 no longer detects the surface 270), or may otherwise be determined. The controller 310 may initiate the sweeping automatically (e.g., when the range sensor 320 detects the surface 270, etc.) and/or in response to a user request from an operator (e.g., when the operator issues a user request through the user interface 350, etc.). While the penetrating nozzle 210 is swept over the surface 270, the range sensor 320 provides range data relating to the distance between the piercing tip 212 and the surface 270 at various angular positions of the penetrating nozzle 210, and the controller 310 stores the range data. The angular positions may be measured relative to gravity, the ground, any component of the fire-fighting vehicle 10 other than the penetrating nozzle 210, or any other reference point. In some embodiments, the tip inclinometer 330 provides angle data relating to the angular position of the penetrating nozzle 210 (e.g., the angle 284, etc.) that corresponds to each range data point, and the controller 310 stores the angle data.

The controller 310 evaluates the range data to locate an angular position of the penetrating nozzle 210 that corresponds to the smallest distance between the piercing tip 212 and the surface 270. By way of example, the controller 310 may search the range data for the smallest distance and use the angle data to determine the corresponding angular position. In situations where the surface 270 is flat or convex, in this angular position the penetrating nozzle 210 is oriented approximately perpendicular to the surface 270. Accordingly, in this angular position, the penetrating nozzle 210 has a known angular orientation relative to the surface 270. After determining the angular orientation of the penetrating nozzle 210 and/or the piercing tip 212 relative to the surface 270 corresponding to one angular position, the controller may use the relative angular displacement of the penetrating nozzle 210 (e.g., as measured using the angle data from the tip inclinometer 330 and/or the boom inclinometer 340) to continuously determine (e.g., track) the angular orientation of the penetrating nozzle 210 and/or the piercing tip 212 relative to the surface 270.

The controller 310 is configured to determine a target range of angular orientations of the penetrating nozzle 210 relative to the surface 270 such that, when oriented within the target range, the penetrating nozzle 210 has an elevated likelihood of successfully penetrating the surface 270. The controller 310 is configured such that the target range includes the orientation in which the penetrating nozzle 210 is approximately perpendicular to the surface. The target range further includes orientations within a predefined range of this orientation (e.g., within two degrees, within 5 degrees, etc.). Accordingly, the controller 310 may correlate the target range of angular orientations of the penetrating nozzle 210 relative to the surface 270 to the angular position of the penetrating nozzle 210 (e.g., measured relative to gravity, the ground, any component of the fire-fighting vehicle 10 other than the penetrating nozzle 210, or any other reference point).

After determining the target range, the operator may provide an input to engage the nozzle actuator 218 and rotate the penetrating nozzle 210 into the target range in preparation for penetrating the surface 270. In some embodiments, the nozzle actuator 218 is controlled by the controller 310 using data from the tip inclinometer 330 to determine when the penetrating nozzle 210 is in the target range (e.g., the penetrating nozzle 210 is rotated until the angle 284 measured by the tip inclinometer 330 is determined by the controller 310 to correspond with an angular orientation within the target range, etc.). In other embodiments, the nozzle actuator 218 is controlled by the controller 310 using data from the range sensor 320 to determine when the penetrating nozzle 210 is in the target range (e.g., the penetrating nozzle 210 is rotated until the distance measured by the range sensor 320 is determined by the controller 310 to correspond with an angular orientation within the target range, etc.). By way of example, the controller 310 may determine that the penetrating nozzle 210 is in the target range when the distance measured by the range sensor 320 is within a predetermined range (e.g., within 5 inches, within 1 inch, within 0.5 inches, etc.) of the smallest distance measured by the range sensor 320 while sweeping the penetrating nozzle 210.

In some embodiments, the nozzle actuator 218 is controlled manually by the operator (e.g., through manual interaction with a valve of a hydraulic system, through interaction with a joystick operatively coupled to the controller 310, etc.). The user interface 350 may provide information to the operator regarding proposed or suggested movements (e.g., prompts the operator to sweep the penetrating nozzle 210, provides the operator with the current angular position relative to the target range, prompts the operator to rotate the penetrating nozzle 210 up or down, etc.). In other embodiments, the nozzle alignment system 358 is automated (e.g., controlled by the controller 310). By way of example, an operator may position the penetrating nozzle 210 along (e.g., nearby, adjacent, etc.) the surface 270, and the controller 310 may automatically (a) sweep the penetrating nozzle 210 (e.g., using the nozzle actuator 218 or the upper actuator 152) (b) determine the target range of angular orientations using range data and angle data and (c) engage various actuators to position the piercing tip 212 within the target range. In other embodiments, the range sensor 320 itself provides a signal that sweeps horizontally and/or vertically, the range sensor 320 itself includes an actuator that sweeps a sensor thereof horizontally and/or vertically, and/or the range sensor 320 otherwise maps the surface 270 so as to reduce or eliminate movement of the penetrating nozzle 210 prior to piercing.

The nozzle alignment system 358 may use angle data to determine an amount of force applied by the piercing tip 212 and whether the amount of force is greater than a minimum amount required to pierce the object. By way of example, a minimum force may be required to pierce the piercing tip 212 through a sheet of a certain material having a certain thickness. The controller 310 may determine the angle 290 using angle data from the tip inclinometer 330 and the boom inclinometer 340, respectively, or from another angle sensor. In some embodiments, the controller 310 is configured to calculate one or both of a piercing force gauge in the extension direction (e.g., parallel to the longitudinal axis 280) and a piercing force gauge in the raise/lower direction (e.g., perpendicular to the longitudinal axis 280) using the angle 290. The piercing force gauge in the extension direction represents the component of a force applied parallel to the longitudinal axis 280 (e.g., a force from the telescoping actuator 172) that acts along the longitudinal axis 276. The piercing force gauge in the extension direction may be determined using the cosine of the angle 290. By way of example, when the piercing force gauge in the extension direction is 0.8, 80 percent of a force applied parallel to the longitudinal axis 280 acts along the longitudinal axis 276. The piercing force gauge in the raise/lower direction represents the component of a force applied perpendicular to the longitudinal axis 280 (e.g., a resultant force from the moment applied to the telescoping boom section 170 by the base actuator 132 and/or the upper actuator 152) that acts along the longitudinal axis 276. The piercing force gauge in the raise/lower direction may be determined using the sine of the angle 290. By way of example, when the piercing force gauge in the raise/lower direction is 0.8, 80 percent of a force applied perpendicular to the longitudinal axis 280 acts along the longitudinal axis 276.

Accordingly, the piercing force gauge may be used to determine an amount of force that will be applied by the piercing tip 212 using a certain actuator based on the angle data from the angle sensor(s). If the force gauge in a certain direction is above or below a threshold value (e.g., a threshold value based on the material properties of the surface 270), the nozzle alignment system 358 may indicate to the operator that the boom assembly 100 should be repositioned before piercing can occur, or that a particular actuator should be used when piercing the surface 270. The force gauge may additionally be used to orient the penetrating nozzle 210 to maximize the force applied to the piercing tip 212 by a particular actuator.

Referring to FIGS. 6A-6E, the controller 310 provides, for representation on a monitor 360, a graphical display 361 provided by the controller 310. The graphical display 361 includes a first indicator, shown as force indicator 362, that indicates to the operator the amount of force that will be applied by the piercing tip 212 to pierce the surface 270. The amount of force may be a numerical amount (e.g., 1000 lbf, etc.) or a relative amount (e.g., 70% of the total force from a particular actuator, 70% of the force necessary to pierce a certain surface, etc.). The amount of force may be determined using the force gauge in the extension and raise/lower directions, geometric relationships between components of the boom assembly 100, and/or the amount of force applied by each actuator. The force indicator 362 is shown as a shape (e.g., a rectangle, etc.) that is progressively illuminated as the amount of force applied by the piercing tip 212 increases. In some embodiments, the force indicator 362 changes color based on the amount of force. By way of example, the force indicator 362 may turn green when the amount of force is above a threshold level (e.g., sufficient to pierce the object, etc.) and red when the force is below a second, lower threshold value (e.g., insufficient to pierce the object, etc.). In some embodiments, the monitor 360 includes an input (e.g., touch buttons, etc.) configured to facilitate selection of the type and/or characteristics of the object associated with the surface 270 by the operator. The controller 310 may receive the input and vary the selective illumination and/or color of the force indicator 362 based on the characteristics of the object.

Referring again to FIGS. 6A-6E, the second indicator, shown as range indicator 364, displays the current distance between the piercing tip 212 to the surface 270 or another object arranged in front of the penetrating nozzle 210. The controller 310 may determine this distance using range data from the range sensor 320 and known dimensions of the nozzle assembly 200 (e.g., the distance between the range sensor 320 and the piercing tip 212, etc.). The range indicator 364 may display the current distance in a numerical format. A third indicator, shown as angle indicator 366, displays a current angle between the longitudinal axis 276 and a horizontal plane (i.e., the angle 284) or another relative angle between components of the nozzle assembly 200. The controller 310 determines these angles using angle data from one or both of the tip inclinometer 330 and the boom inclinometer 340 or a different type of angle sensor. The angle indicator 366 may display the current angle in a numerical format.

Referring again to FIGS. 6A-6E, a fourth indicator, shown as movement prompt 368, provides operating instructions to the operator outlining which direction to rotate the penetrating nozzle 210 in order to bring the penetrating nozzle 210 within the target range of angular orientations. The movement prompt 368 may instruct the operator to rotate the penetrating nozzle 210 in a first direction or in a second direction opposite the first direction depending on the current angular orientation of the penetrating nozzle 210 and/or the piercing tip 212 relative to the target range. By way of example, if the nozzle alignment system 358 determines that the penetrating nozzle 210 should be moved upwards (e.g., when the penetrating nozzle 210 is oriented below the target range), the movement prompt 368 may display an upward pointing arrow. By way of another example, if the nozzle alignment system 358 determines that the penetrating nozzle 210 should be moved downwards (e.g., when the penetrating nozzle 210 is oriented above the target range), the movement prompt 368 may display a downward pointing arrow. By way of yet another example, if the penetrating nozzle 210 is properly aligned (i.e., the penetrating nozzle 210 is within the target range), the movement prompt 368 may display a checkmark. In other embodiments, the movement prompt 368 indicates similar information using a different graphic (e.g., using different shapes, colors, etc.). As shown in FIG. 6B, the movement prompt 368 may indicate when the nozzle assembly 200 is in a stored position.

Referring to FIGS. 6A-6E a fifth indicator, shown as visualizer 370, includes a first graphic, shown as tip indicator 372, a second graphic, shown as boom indicator 374, and a third graphic, shown as angle register 376. The tip indicator 372 shows the current angular position of the penetrating nozzle 210 such that the penetrating nozzle 210 is oriented horizontally (i.e., parallel to a horizontal plane) when pointing to the left. The tip indicator 372 is shown as a simplified image of the penetrating nozzle 210. The tip indicator 372 rotates to match the current angular position of the penetrating nozzle 210 in real time. The boom indicator 374 may show the current angular position of the telescoping boom section 170. The boom indicator 374 is shown as a simplified image of the telescoping boom section 170. The boom indicator 374 rotates to match the current angular position of the telescoping boom section 170 in real time. In some embodiments, the tip indicator 372 and the boom indicator 374 both rotate about the same point, where the point represents the axis about which the penetrating nozzle 210 rotates relative to the telescoping boom section 170.

The angle register 376 cooperates with the tip indicator 372 to indicate to the operator the orientation of the penetrating nozzle 210 and/or the piercing tip 212 relative to the target range of orientations. In some embodiments, the angle register 376 includes angle markings (e.g., at 0, 90, and −90 degrees from horizontal). As shown in FIGS. 6B and 6C, the angle register 376 includes a graphic, shown as target range indicator 378, that represents the size and relative angular position of the target range. When the tip indicator 372 overlaps the target range indicator 378, the penetrating nozzle 210 is within the target range. Accordingly, the size of the target range indicator 378 varies with the size of the target range. Due to the relationship between the target range and the surface 270, the target range indicator 278 shows the angular orientation of the surface 270 relative to the penetrating nozzle 210. In some embodiments, the graphical display 361 further includes a graphic showing a simplified image of the surface 270 (e.g., a circle) arranged adjacent the target range indicator 378. Alternatively, the target range indicator 278 may be configured to selectively indicate a different target range. By way of example, in response to a user request, the controller 310 may reposition the target range indicator 378 such that it targets a particular position specified by the operator (e.g., a position where the longitudinal axis 276 is horizontal).

As shown in FIGS. 6B-6E, the graphical display 361 includes a sixth indicator, shown as extension indicator 380. In some embodiments, the monitor 360 includes an input (e.g., touch buttons, etc.) configured to facilitate selection by the operator of a number of length extensions attached to the penetrating nozzle 210 (e.g., currently attached, to be attached, etc.). The length extensions may vary the length of the piercing body 216 as they are added to or removed from the penetrating nozzle 210 (e.g., by an operator, etc.). In some embodiments, the nozzle assembly 200 includes a sensor configured to cooperate with the controller 310 and facilitate determining at least one of an overall length of the length extensions, the number of length extensions in use, an overall length of the penetrating nozzle 210, and an overall length of the piercing body 216. As shown in FIGS. 6B-6E, the extension indicator 380 displays the number of length extensions in a numerical format. In other embodiments, the extension indicator 380 displays the overall length of the length extensions and/or another length (e.g., the overall length of the piercing body 216, etc.). In some embodiments, each length extension has a predefined length (e.g., 12 inches, 16 inches, 24 inches, etc.). The controller 310 may be configured to use at least one of the number of length extensions, the length of each length extension, the overall length of the length extensions, an overall length of the penetrating nozzle 210, an overall length of the piercing body 216, and/or other information to determine the distance from the piercing tip 212 to (a) another point on the nozzle assembly 200 and/or (b) the surface 270.

Figure 6A:
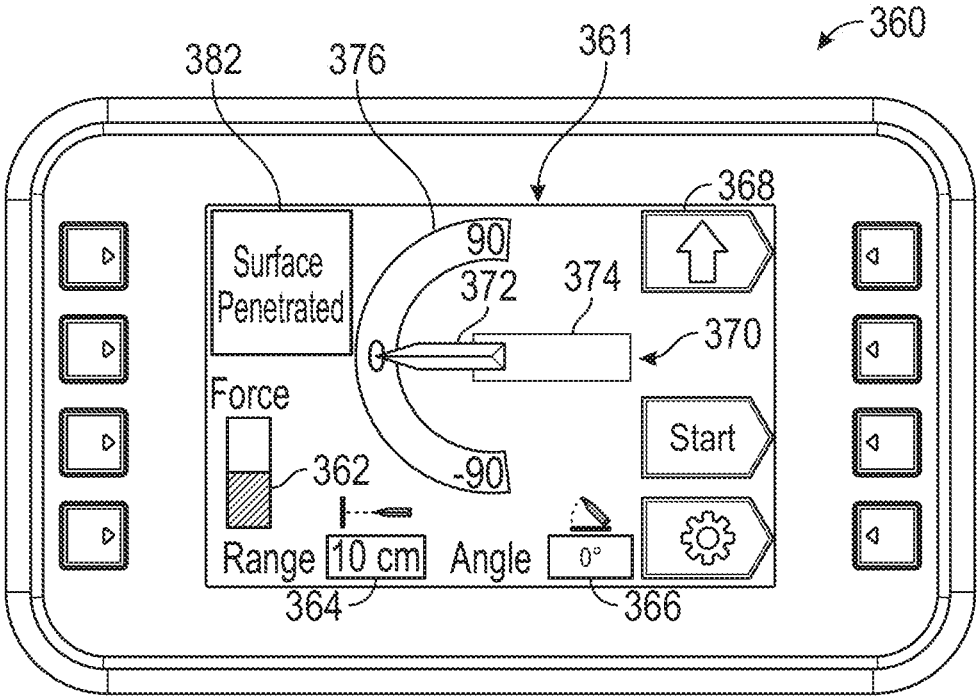
FIG. 6A is a front view of a monitor of a fire-fighting vehicle, according to an exemplary embodiment.
Figure 6B:
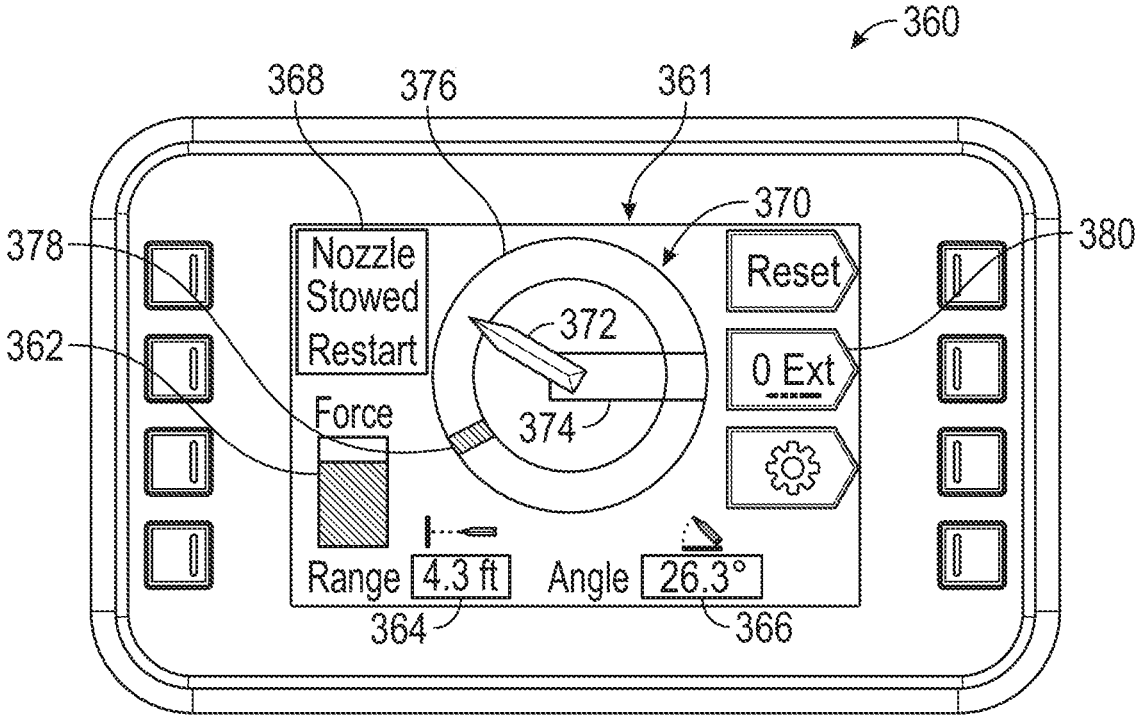
FIG. 6B is a front view of a monitor of a fire-fighting vehicle, according to another exemplary embodiment.
Figure 6C:
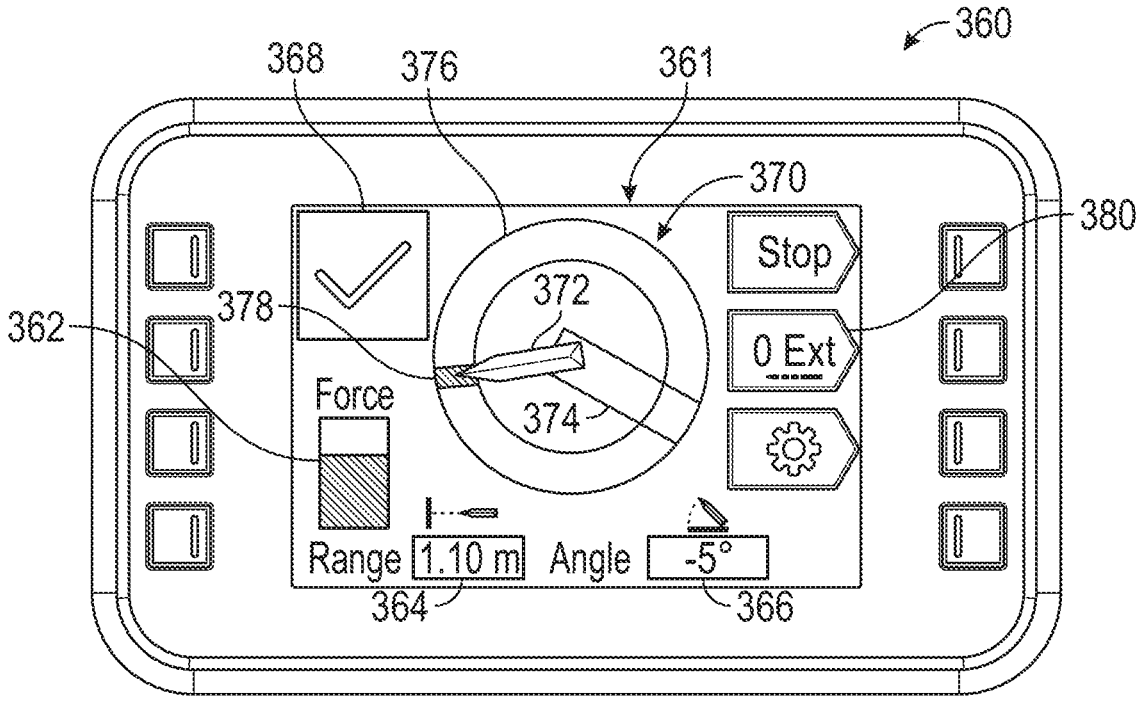
FIG. 6C is a front view of a monitor of a fire-fighting vehicle, according to another exemplary embodiment.
Figure 6D:
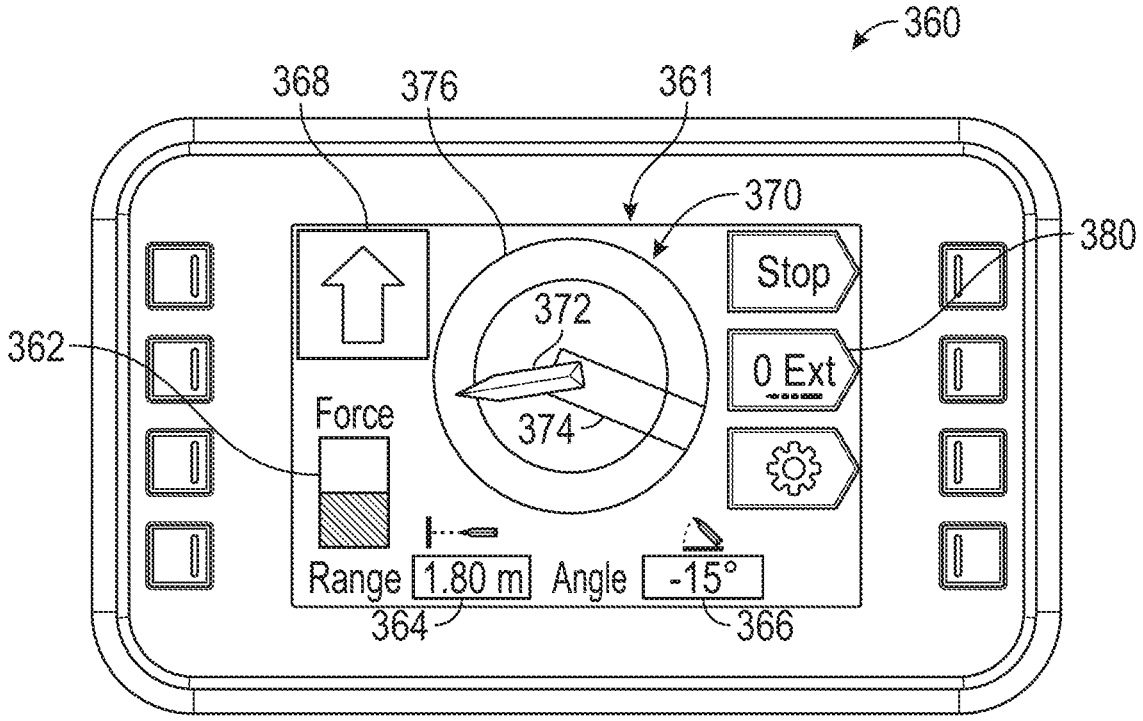
FIG. 6D is a front view of a monitor of a fire-fighting vehicle, according to another exemplary embodiment.
Figure 6E:
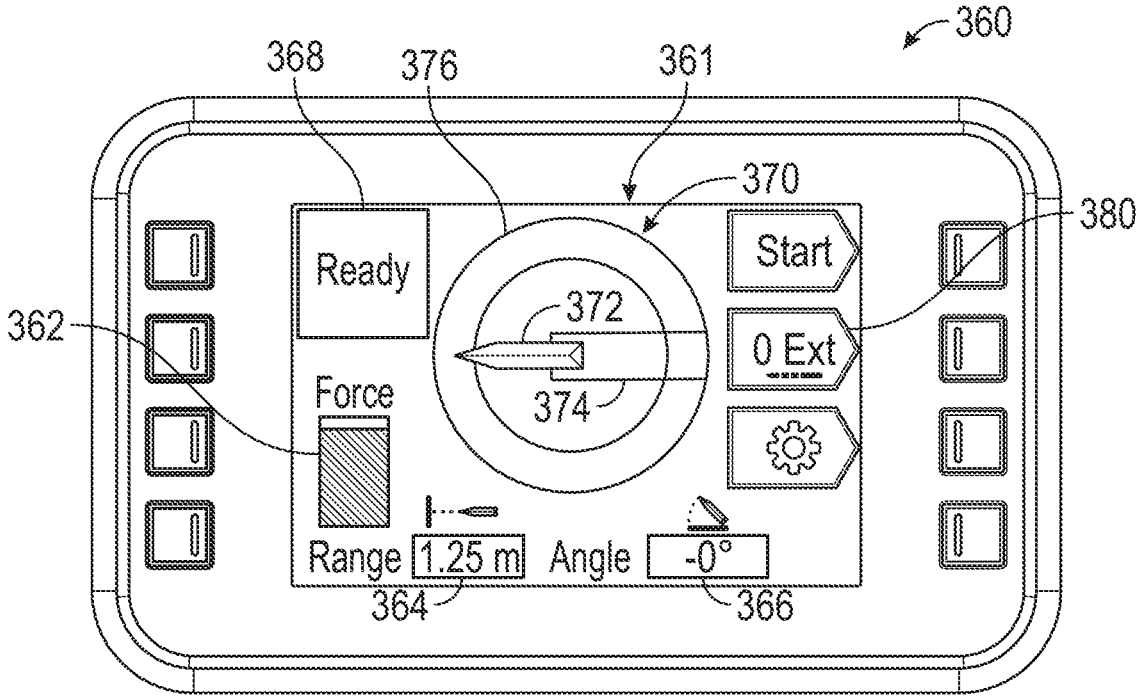
FIG. 6E is a front view of a monitor of a fire-fighting vehicle, according to another exemplary embodiment.

Referring to FIG. 6A, in some embodiments, the graphical display 361 further includes a seventh indicator, shown as penetration indicator 382. The penetration indicator 382 indicates to an operator when the penetrating nozzle 210 has been inserted into an object at least a threshold distance. This threshold distance corresponds to an insertion depth at which the outlet can supply fire suppressant into an interior cavity of the object through the outlets of the outlet portion 214. By way of example, in an embodiment where the outlets of the outlet portion 214 are located 6 inches from the end of the piercing tip 212, the threshold distance may be 6.25 inches. The controller 310 may be configured to determine whether the penetrating nozzle 210 has penetrated the threshold distance using range data from the range sensor 320 and the geometry of the nozzle assembly 200 (e.g., the distance from the piercing tip 212 to the range sensor 320. Once the controller 310 determines that the penetrating nozzle 210 has penetrated the threshold distance, the controller 310 provides a notification to the operator. As shown in FIG. 6A, the notification is a message shown on the penetration indicator 382. In other embodiments, the notification is auditory (e.g., a beeping sound).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

For purposes of this disclosure, the term "coupled" means the joining of two members directly or indirectly to one another. Such joining may be stationary in nature (e.g., permanent, etc.) or moveable in nature (e.g., removable, releasable, etc.). Such joining may allow for the flow of electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

The construction and arrangements of the systems and methods, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements. The position of elements may be reversed or otherwise varied. The nature or number of discrete elements or positions may be altered or varied. Although the figures may show a specific order of method steps, the order of the steps may differ from what is depicted. Also two or more steps may be performed concurrently or with partial concurrence. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention. All such variations are within the scope of the disclosure. Likewise, software implementations could be accomplished with standard programming techniques with rule based logic and other logic to accomplish the various connection steps, processing steps, comparison steps and decision steps. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claim.

What is claimed is:

1. A fire-fighting vehicle, comprising:

a chassis;

a boom assembly movably coupled to the chassis;

a penetrating nozzle coupled to the boom assembly, the penetrating nozzle including:

a piercing tip extending along a longitudinal axis and configured to be selectively repositioned relative to a surface of an object having an interior cavity; and an outlet configured to be selectively fluidly coupled to a supply of fire suppressant, wherein the outlet is positioned to supply fire suppressant into the interior cavity when the piercing tip is within the interior cavity of the object;

an actuator configured to rotate the penetrating nozzle relative to the chassis;

a range sensor configured to provide range data relating to a distance between the piercing tip and the surface;

a controller comprising a processing circuit configured to receive the range data;

a user interface operatively coupled to the controller; and wherein the controller is configured to:

provide, for representation on the user interface, a graphical display showing at least one of a position and an orientation of the piercing tip relative to the surface and relative to the boom assembly, determine, based on the range data, an insertion depth of the penetrating nozzle into the object, determine that the insertion depth is equal to or greater than a threshold distance into the object, and provide, for representation on the user interface, a graphical display indicating that the insertion depth is equal to or greater than the threshold distance, and wherein the threshold distance is based on an insertion depth that facilitates fire suppressant introduction, through the outlet, into the interior cavity.

2. The fire-fighting vehicle of claim 1, wherein the controller is further configured to:

engage the actuator such that the penetrating nozzle sweeps through an angular range at least one of automatically and in response to a user request, store the range data corresponding to various angular positions of the penetrating nozzle as the actuator rotates the penetrating nozzle, and determine an angular orientation of the piercing tip relative to the surface using the stored range data.

3. The fire-fighting vehicle of claim 1, wherein the controller is further configured to:

determine a target range of angular orientations for the penetrating nozzle relative to the surface, and determine the target range of angular orientations based on an evaluation of orientations that have elevated likelihoods of successfully penetrating the surface, and wherein the target range of angular orientations includes an angular orientation in which the distance between the piercing tip and the surface is smallest.

4. The fire-fighting vehicle of claim 1, wherein the longitudinal axis of the penetrating nozzle defines a first axis, wherein the boom assembly includes a first section coupled to the chassis, a second section slidably coupled to the first section and coupled to the penetrating nozzle, and a second actuator, wherein the second actuator is configured to extend and retract the second section relative to the first section along a second axis with an extension force, wherein the angle data relates to an angle between the first axis and the second axis, and wherein the controller is further configured to determine an amount of force applied along the first axis by the piercing tip based on the angle data and the extension force.

5. The fire-fighting vehicle of claim 1, wherein the graphical display further comprises information including at least one of (a) a current distance between the piercing tip and the surface and (b) a current angle between the longitudinal axis of the penetrating nozzle and a horizontal plane.

* * * * *